United States Patent [19]

Ziegler

[11] 4,331,628

[45] May 25, 1982

[54] METHOD FOR PREPARING A FINISHED CONCRETE PART

[75] Inventor: Johannes Ziegler, Viersen, Fed. Rep. of Germany

[73] Assignee: Feldmühle Anlagen-und Produktionsgesellschaft mbH, Duesseldorf-Oberkassel, Fed. Rep. of Germany

[21] Appl. No.: 47,872

[22] Filed: Jun. 12, 1979

Related U.S. Application Data

[63] Continuation of Ser. No. 817,970, Jul. 22, 1977, abandoned.

[30] Foreign Application Priority Data

Jul. 28, 1976 [DE] Fed. Rep. of Germany ..... 2633900

[51] Int. Cl.[3] ..... B28B 7/36

[52] U.S. Cl. ..... 264/553; 264/71; 264/220; 264/316; 264/338

[58] Field of Search ..... 264/71, 316, 338, 553, 264/220

[56] References Cited

U.S. PATENT DOCUMENTS 3,492,384 1/1970 Matthews ..... 264/71

3,995,086 11/1976 Plungian ..... 264/338 X

FOREIGN PATENT DOCUMENTS 2053248 4/1972 Fed. Rep. of Germany .

*Primary Examiner*—Thomas P. Pavelko

*Attorney, Agent, or Firm*—Toren, McGeady and Stanger

[57] ABSTRACT

A finished concrete part is prepared in a casting mold with a perforated mold wall. A pliable thermoplastic film is placed over the inner surface of the casting mold wall, the film is heated sufficiently to make is supple enough to conform to the inner mold wall surface, the supple film is sucked against the inner mold wall surface under vacuum, the lined mold is filled with concrete, the concrete is permitted to harden in the lined mold while being vibrated to compact the concrete in the mold during hardening, and the hardened finished concrete part is removed from the mold.

4 Claims, 7 Drawing Figures

Figure 5:
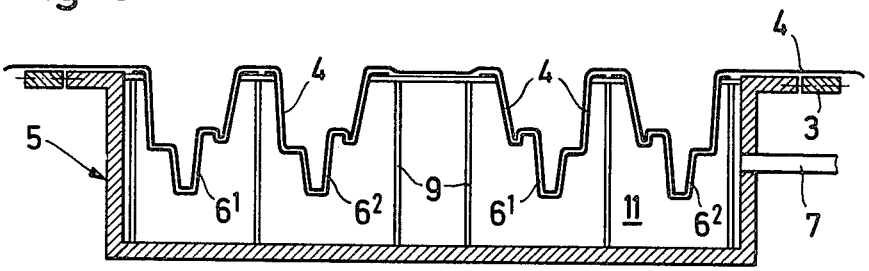

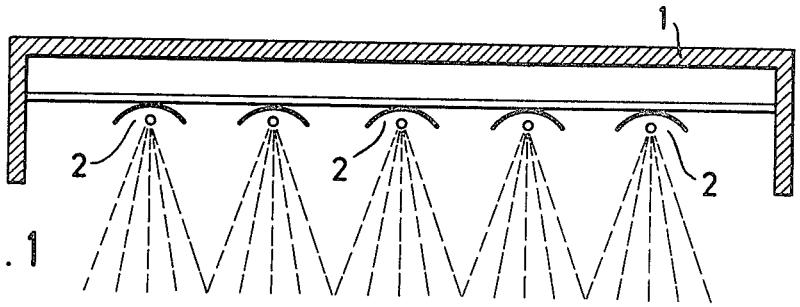
Fig. 1
Fig. 2
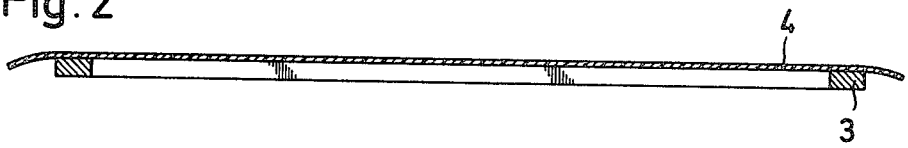
Fig. 3
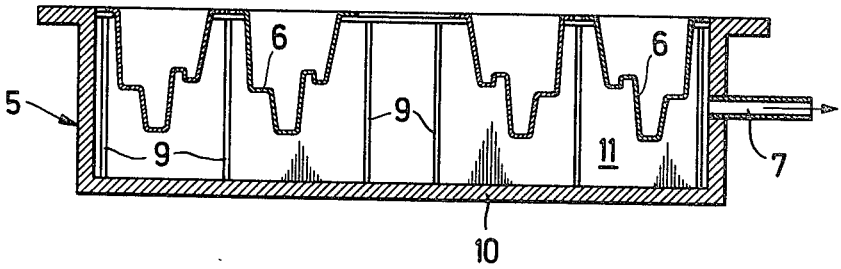
Fig. 4
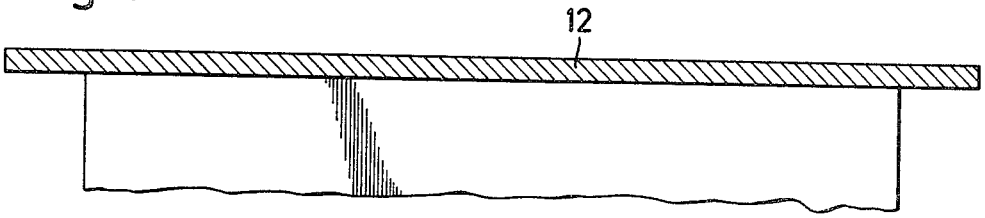

METHOD FOR PREPARING A FINISHED CONCRETE PART

This is a continuation of application Ser. No. 817,970 filed July 22, 1977 now abandoned.

The present invention relates to improvements in a method and casting mold for preparing a finished concrete part having a smooth, non-porous surface of a high gloss without the use of a spatula. Such finished concrete parts may find use as flower boxes, window sashes, facade wall plates, door and window sashes or frames and the like.

It is well known to cast concrete into suitably shaped casting molds to prepare correspondingly shaped finished concrete parts. In such molds, the concrete is poured into the mold cavity, compacted by vibration while hardened in the mold, and the hardened finished concrete part is then removed from the mold. It has also been proposed to prepare complex concrete shapes, such as door frames, in molds (see German Published Application No. 2,430,640). It is also known to produce concrete parts with visible surfaces which are relatively smooth. In all of these cases, a mold of wood, metal or rigid synthetic resin has been coated with a separating medium, such as a wax or silicone oil, before the concrete was poured into the mold cavity, or the mold cavity was lined with a pliable film of synthetic resin, for instance polyethylene. However, despite the use of separating or anti-sticking media, considerable difficulties have been encountered in the removal of the hardened concrete part from the mold and it has proved to be impossible cleanly to remove the part without some concrete adhering to the mold wall. This then requires cleaning of the mold before it can be used again, and the cleaning often leads to scratching or other damage to the mold wall so that even steel molds have a relatively short operating life. In addition, the finished concrete part has a relatively low surface quality, is porous and rough at points where concrete adhered to the mold wall. Even a film lining does not provide an acceptable solution to this problem, particularly with complex and relatively deep shapes, probably because the film is displaced relative to the mold cavity wall when the concrete is poured thereinto or when the mold is vibrated so that faulty surface portions are formed in the hardened part. Furthermore, if the mold cavity is relatively deep, special film linings must be manufactured to fit the cavity, and these linings must have a relatively heavy gage to make handle them in transport and during lining. Such linings are, therefore, relatively expensive.

It is the primary object of this invention to overcome the above disadvantages and to provide a method and mold for preparing a finished concrete part, which meets the following conditions:

(1) Assembly-line manufacture of concrete parts, including particularly complex parts, such as door or window frames, and surfaces simulating wood grains or the like.

(2) Accurate reproduction of the mold cavity surface shape in the surface of the finished concrete part while assuring high surface quality, particularly a smooth and non-porous concrete surface.

(3) Mass production of a large number of finished concrete articles of identical shape in a single mold.

(4) Easy and complete removal of the finished concrete part from the mold.

(5) After removal of each part, the mold requires little or no cleaning.

The above and other objects are accomplished in accordance with the invention with a method comprising the steps of placing a pliable film of thermoplastic synthetic resin over the inner surface of a casting mold, heating the film rapidly to a temperature below the melting point of the synthetic resin but sufficient to make the film supple enough to conform to the inner mold surface, sucking the supple film against the inner mold surface under vacuum to provide a mold surface lining, filling the lined mold with concrete, permitting the concrete in the lined mold to harden while vibrating the concrete to compact the concrete in the mold during hardening, and removing the hardened finished concrete part from the mold. The film is preferably heated to a temperature of 100° C. to 130° C. within a period of 20 to 70 seconds by a bank of infrared heaters spaced from each other a distance of 120 mm to 400 mm, and the vacuum pressure is preferably from 150 to 600 Torr.

The casting mold of the present invention comprises a perforated mold wall having an inner surface, means for applying a vacuum to the perforated mold wall, a pliable film of thermoplastic synthetic resin conformingly pressed against the inner surface of the perforated mold wall under the applied vacuum, and heating means arranged to heat the film rapidly, the perforated mold wall having a multiplicity of bores whose number and diameter are selected in dependence on the shape of the mold, the thickness of the film and the grain size of the concrete. The bores preferably have a diameter of 0.6 to 1.0 mm and are spaced apart 10 to 300 mm.

While Published German Application No. 2,053,248 discloses a method of preparing parts, which comprises placing a thin pellicle over the inner surface of a casting mold, sucking the pellicle against the inner mold surface under vacuum to provide a mold surface lining, filling the lined mold with a mass, permitting the mass to harden in the lined mold, and removing the hardened part from the mold, the publication is silent about the material of the pellicle and does not suggest the use of the thermoplastic film which is heated before the vacuum is applied to make certain that it fully conforms to the inner mold surface. Also, the mass is a synthetic resin containing fillers and not concrete.

Figure 6:
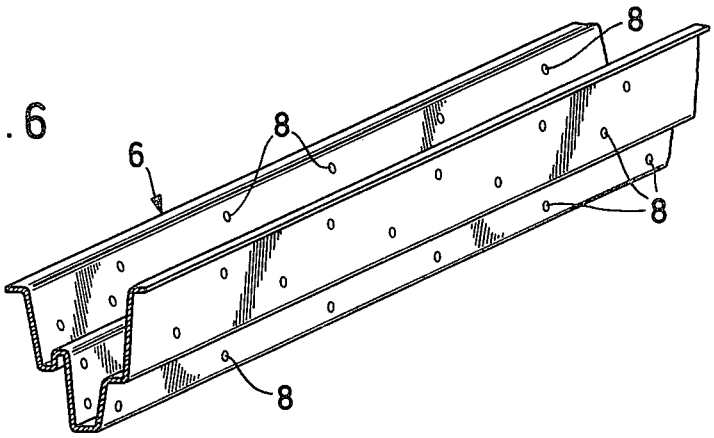
Figure 7:
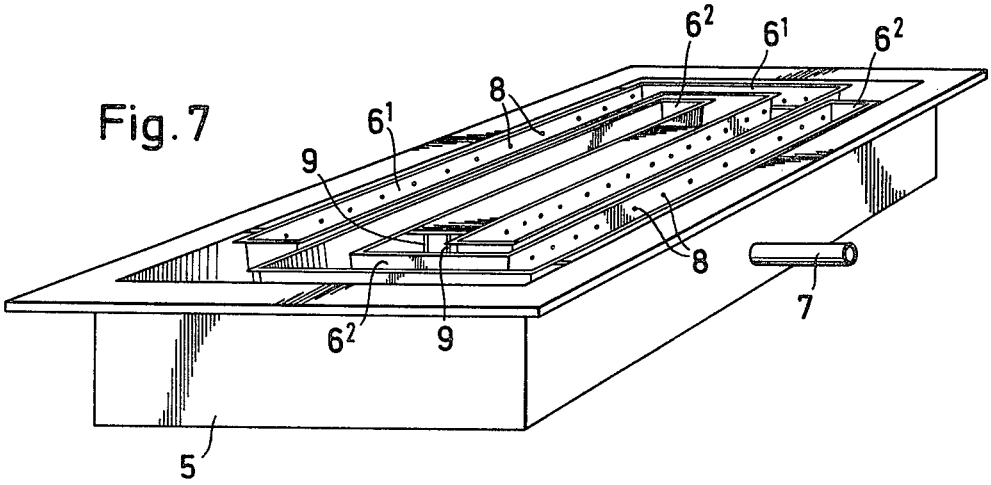

The objects, advantages and features of this invention will become more apparent from the following detailed description of certain now preferred embodiments thereof, taken in conjunction with the accompanying drawing wherein FIG. 1 shows an infrared heater unit, FIG. 2 illustrates a tensioning frame for the film, FIG. 3 is a transverse section of a vacuum box and a casting mold for making a sash inserted therein, FIG. 4 shows a vibrating table, FIG. 5 is similar to FIG. 3, also showing the mold lining, FIG. 6 is a perspective view of a mold shaped to produce a sash, and FIG. 7 is a perspective view of a vacuum box with the inserted casting mold filled with concrete.

Referring now to the drawing and first to FIG. 1, there is shown a heating means arranged to heat film 4 (FIG. 2) rapidly, the heating means including housing 1 containing a bank of infrared radiation heaters 2 spaced from each other a suitable distance of preferably 50 mm to 100 mm and having a power of about 10 to 16 kW/m². At a distance of about 400 mm, these heaters produce an energy density of about 2 to 6 kW/m². Housing 1 is movable along a track (not shown) to place it above tension frame 3 (FIG. 2) which holds film 4, which may be of polyethylene or any other suitable thermoplastic synthetic resin, such as an ethylene-vinyl acetate copolymer containing 20%, by weight, of vinyl acetate. Copolymers of ethylene and 5.0 to 25%, by weight, of vinyl acetate have been found useful. Film 4 is clamped to tension frame 3 and the tension frame is mounted for vertical movement so that it may be lowered onto vacuum box 5 (FIG. 3).

The illustrated vacuum box holds four casting molds 6 shown more clearly in FIG. 6. Each mold consists of a perforated mold wall of extruded aluminum and has two flanges for support on vertical spacers 9 suspending the molds above bottom 10 in the vacuum box. Obviously, any desired number of molds may be mounted on the vacuum box and the molds have suitable shapes conforming to the desired shapes of the cast concrete parts. The perforated mold walls have bores having a diameter of 0.6 to 1.0 mm which are spaced apart 10 to 300 mm, preferably no more than about 50 mm. Means for applying a vacuum to the perforated mold wall includes vacuum pipe 7 leading into space 11 between bottom 10 of the vacuum box and molds 6 and connected to a source of vacuum, such as an exhaust pump.

The vacuum box is affixed to vibrating table 12 (FIG. 4) which may be vibrated at a selected frequency, preferably between 6 and 16 kHz.

As shown in FIG. 5, after tension frame 3 with film 4 clamped thereto is mounted on vacuum box 5 to close the box, the infrared heater unit is moved over the vacuum box and infrared heaters 2 are operated for a suitable period of time which may last 1 to 2.5 minutes but is preferably 20 to 70 seconds. After film 4 has thus been heated to a point where it is supple enough to conform to the inner surfaces of molds 6, vacuum is applied through pipe 7 to space 11, the vacuum penetrating through the bores in the mold walls, into the mold cavity to pull down film 4 and suck it into conforming adherence to the inner surface of the mold to provide a mold surface lining. The vacuum may be about 500 Torr, a range of 150 to 600 Torr being useful. While FIG. 5 shows the inner mold surfaces separate from film 4, for the sake of illustration, there is no space between the mold surfaces and the film in reality, the film conforming closely to the mold surfaces under the sucking action of the vacuum. After the infrared heater unit has been removed and the lining has been applied to the inner mold surfaces, the lined molds are ready to be filled with concrete, as shown in FIG. 7.

After the molds have been filled with concrete mixture, vibrating table 12 is vibrated, for instance at a frequency of 6 to 8 kHz while the vacuum is maintained. Vibration is continued for about 60 to 180 seconds, and, after it is discontinued, a smoothing bar is run over the molds to smooth the exposed surfaces of the molded parts in the molds. After the molded concrete parts have hardened in their molds, the finished parts are removed from the mold, preferably with the lining film remaining thereon. This surface film is removed only after the part, for instance as a door frame, has been built into a structure.

The present invention makes the use of conventional separating or anti-sticking media for concrete molds unnecessary while assuring effective and clean separation of the finished concrete part from the mold, the concrete being nowhere in contact with the mold wall. Adherence to the mold wall is, therefore, impossible. Subsequently, the mold cannot be encrusted and need not be cleaned. Furthermore, in contrast to a synthetic resin film, conventional separating media, such as waxes or oils, tend to penetrate into the surface of the mold and/or the molded concrete, possibly damaging the former and providing the latter with an undesirable coating of a separating medium which will have an undesirable separating effect on a coating of paint applied to the concrete surface.

The use of the thermoplastic film lining also has the advantage that, independent of the material of the mold wall, the concrete always is in contact with the same material, i.e. the film, thus assuring a uniform surface quality. When untreated wood is used as the mold wall and these wooden mold walls are coated with a separating oil, some of the chemical components of the wood and the fine particles of the cement components of the concrete form chemical compounds tending to discolor portions of the concrete surface. This is limited to certain portions of the wooden mold wall and thus produces a checkered surface appearance.

It should be noted that the vacuum sucking the lining film against the inner mold surface has nothing to do with the conventional application of vacuum in the production of concrete shapes. In this conventional operation, vacuum is applied to the largely fluid concrete mass to remove air and water therefrom so as to avoid the formation of bubbles in the finished concrete. The vacuum in the present method is not applied to the concrete mass but to the lining to suck the same against the mold wall and conform it closely thereto, holding the lining in position against displacement not only while the mold is filled with concrete but also while it is vibrated and hardened.

The concrete parts finished in this manner have been found to have an unexpectedly smooth and non-porous surface of a high gloss without the use of a spatula. Such a concrete part in the form of a door frame, for example, may be built in without further treatment as it is removed from the mold. If desired, it may be painted unless the concrete mass itself has been suitably colored. While I am not bound to any theory for the reason of this quality surface of concrete parts produced by the method and with the mold of this invention, it may be due to the avoidance of any relative movement between the lining and the mold wall by sucking the supple film against the inner mold surface. This would normally arise when the heavy concrete mass is poured into the mold and the mold is then vibrated if the lining is merely loosely placed over the inner mold surface. Therefore, the vacuum is maintained until vibration has been terminated, this time depending, as is well known, on the type of concrete used, the dimensions and shape of the mold, the consistency of the concrete, etc.

Within the preferred range indicated hereinabove, the selected vacuum depends on the size and shape of the mold and the resultant surface areas, as well as the pliability of the synthetic resin film which is partly a function of its thickness. While a vacuum in excess of 600 Torr may be used, no improvements have been noted with higher vacuums so that they would involve merely a waste of energy. On the other hand, a vacuum below about 150 Torr will be effective for purposes of the present invention only if the mold surfaces are more or less plane. It will not be effective with complex mold surfaces to produce the desired high surface quality of the finished concrete parts.

In operation, it has been found effective to heat the thermoplastic synthetic resin film to a temperature of 100° C. to 130° C. for 20 to 70 seconds by a bank of infrared heaters spaced from the film a distance of 120 mm to 400 mm. In this manner, preforming of the mold lining to conform to complex inner mold surfaces is avoided and most accurate conformance of the supple film to the mold surface is assured when the film is sucked against the surface. According to the method of this invention, the lining is shaped and maintained against displacement in a single step by the vacuum applied to the perforated mold wall. Heating of the film makes it supple enough to conform to the inner mold surface so that the lining has the exact shape of the mold and thus transmits this exact shape to the finished concrete part. In this manner, it is possible to manufacture series of complexly shaped concrete parts as well as concrete parts with special surface effects, such as wood grain, for example, without damage to the grain of a wooden mold, for instance, and the need for cleaning such molds.

Preferably, the mold is vibrated at a frequency of 6 to 16 kHz for 3 to 180 seconds while being kept under vacuum, the vibrating frequency and time necessary to compact the concrete in the mold depending largely on the size and shape of the concrete part. A minimum frequency of 6 kHz is desirable to obtain the desired high surface quality of the concrete part and this will be further enhanced by the use of a thin film of ethylene copolymer, which will produce a high surface gloss effect. Higher vibrating frequencies than 16 kHz produce no improved results and, therefore, only waste energy. In most practical cases, a vibrating frequency of 7 to 10 kHz has been found useful.

While various thermoplastic synthetic resins may be used for the film and the film may have any suitable thickness assuring its suppleness after heating, ethylene copolymers have been found most useful for films having preferably a thickness of 15 to 150$\mu$. It is essential for the film to be very pliable and supple after heating so that it may conform very closely to the mold surface. The film gage has an important bearing on this and the film should be as thin as practically feasible without breaking under suction.

Synthetic resins composed predominantly of polyethylene are preferred because polyethylene is resistant to most chemical agents and is inert to concrete as well as the mold materials. It has the further advantage of having a wax-like quality which makes separating easy and provides a hydroophobic film in contact with the concrete. Thus, the finished concrete part may be removed readily from the mold cavity and the film may be removed without difficulty from the finished part after it has been used, if desired, as a protective covering and also serves to prevent evaporation of the water necessary for the setting of the concrete. On the other hand, since polyethylene is hydrophobic, it will not absorb water from the concrete. If the film remains on the concrete part, it will protect it while being built in and during subsequent painting of the surrounding structure. After the structure has been completed, the film can simply be peeled off to expose the structural concrete part with its glossy surface.

Ethylene-vinyl acetate copolymers containing 5.0 to 25%, by weight, of vinyl acetate are very useful materials for the films used in this invention, the vinyl acetate content preferably increasing with the complexity of the mold surface since the film will have an increased extensibility and plasticity with an increase in vinyl acetate content.

The perforated wall of the casting mold of the present invention has a multiplicity of bores whose number and diameter are selected in dependence on the shape of the mold, the thickness of the film and the grain size of the concrete, the bores preferably having a diameter of 0.6 to 1.0 mm and a spacing of 10 to 300 mm from each other. The bores are distributed over the entire wall surface and they are spaced more closely at points where the film is bent. Also, the bore diameters are selected larger where the shape of the mold wall makes holding the film in tight contact with the wall more difficult. If the bores have a diameter towards the upper limit of the indicated range and the film is very thin, there may be a danger of the thin film being sucked into the bore rather than remaining flush with the mold surface. This would create pimples on the surface of the finished concrete part. Therefore, the diameter of the bores must be selected in dependence on the thickness of the film and the grain size of the concrete, penetration of the poured concrete mass into such tiny pockets of the film at extralarge bores being avoided if the grain size of the concrete is in the range of the diameter of the bores or, preferably, larger. If a very fine-sized grain size is used, it will be advantageous to provide a heavier-gage film so as to avoid its being sucked into the bores by the applied vacuum. In this manner, a smooth surface of the finished concrete part will be obtained under all operating conditions.

What I claim is:

1. A method for preparing a finished concrete product with a smooth surface comprising the steps of: providing a concave casting mold formed from wall means having a plurality of perforations generally uniformly distributed therethrough adapted for permitting a vacuum to be drawn on the interior of said mold, said wall means defining said mold with upper edge portions adapted to receive in supportive engagement therewith a plastic film of thermoplastic synthetic resin; applying a plastic film of thermoplastic synthetic resin on said edge portions with said film arranged to extend over the interior of said mold; heating said plastic film to a temperature below its melting point but sufficient to render said film supple while maintaining said film in supportive engagement on said edge portions over the interior of said mold; applying a vacuum through said perforations in said wall means while said plastic film is in the heated condition so as to evacuate the interior of said mold thereby to draw said heated film into conformance with the contour of said mold interior; filling said mold interior with concrete mixture which is introduced over said plastic film while maintaining said vacuum on said mold; compacting said concrete mixture while permitting said concrete to harden and while maintaining said vacuum; and releasing the hardened, finished concrete part formed from said concrete mixture from said mold.

2. The method of claim 1, wherein the synthetic resin is an ethylene copolymer and the film has a thickness of 15 to 150$\mu$.

3. The method of claim 2, wherein the synthetic resin is an ethylene-vinyl acetate copolymer.

4. The method of claim 3, wherein the copolymer contains from 5.0 to 25%, by weight, of vinyl acetate.

* * * * *